US006010186A

United States Patent [19]

Tsay

[11] Patent Number: 6,010,186

[45] Date of Patent: Jan. 4, 2000

[54] COMBINATION DESK AND CHAIR

[76] Inventor: Jenn-Long Tsay, No. 137, Chienfeng Rd., Kangshan Chen, Kaohsiung Hsien, Taiwan

[21] Appl. No.: 09/260,786

[22] Filed: Mar. 2, 1999

[51] Int. Cl.[7] ..... A47B 3/14

[52] U.S. Cl. ..... 297/159.1; 297/158.4; 297/173; 297/174

[58] Field of Search ..... 297/170, 172, 297/173, 174, 158.4, 159.1; 108/119

[56] References Cited

U.S. PATENT DOCUMENTS

| | | | |
|---|---|---|---|
| 2,643,925 | 6/1953 | Derman | 108/119 |
| 2,973,803 | 3/1961 | Mickelson | 297/170 |
| 4,289,350 | 9/1981 | Thomas et al. | 297/158.4 |
| 5,685,602 | 11/1997 | Williams | 297/174 |
| 5,876,093 | 3/1999 | Williams | 297/174 |

*Primary Examiner*—Anthony D. Barfield
*Attorney, Agent, or Firm*—Thomas, Kayden, Horstemeyer & Risley

[57] ABSTRACT

A combination desk and chair includes two pairs of foldable legs with a desk surface supported thereon and the chair having two legs pivotally extending from the underside thereof. Two connecting devices are connected between the chair and the legs of the desk, each connecting device including an outer tube and an inner tube that is slidably received in the outer tube so that the distance between the desk and the chair is adjustable. The foldable legs of the desk and the chair with the legs thereof are foldable to make the combination desk and chair have a compact size.

9 Claims, 9 Drawing Sheets

COMBINATION DESK AND CHAIR

FIELD OF THE INVENTION

The present invention relates to a combination desk and chair that is connected to the desk by two retractable tubes, and the combination desk and chair can be folded to a compact size.

BACKGROUND OF THE INVENTION

To save time in arranging desks and chairs, a combination desk and chair is developed. The combination includes a desk having a desk surface with two supporting frames and a chair having a seat with two legs. The desk surface and the seat are made of plastic material so that the manufacturing is convenient and quick, and the supporting frames and the legs generally are made of metal tubes which are bent into desired shape so as to have the desired features. The metal tubes are fixedly connected to the desk surface and the seat by rivets to be a one-piece member so that the combination is easily moved. Nevertheless, the combination occupies a large space so that it will be a problem to store or transport multiple sets of the combination. For example, when all the sets in a classroom are required to be removed so as to have an empty space, it is impossible to collect all the sets while an enough space is maintained.

The present invention intends to provide a combination desk and chair, the desk and chair can be folded to a compact size. According to the present invention, the disadvantages of the conventional combination of a desk and a chair are mitigated.

SUMMARY OF THE INVENTION

In accordance with one aspect of the present invention, there is provided a combination desk and chair, comprising an inverted U-shaped member having two first legs connected by a transverse bar, two foldable members each having a horizontal section with a desk surface supported thereon and a supporting section pivotably connected to the horizontal section. The chair comprises a seat with two second legs pivotally extending from the underside of the seat. Two retractable connecting means are respectively connected between the two first legs and the chair.

It is an object of the present invention to provide a combination desk and chair wherein the distance between the desk and the chair is adjustable.

Another object of the present invention is to provide a combination desk and chair wherein the combination can be foldable to become a compact collection.

Further objects, advantages, and features of the present invention will become apparent from the following detailed description with appropriate reference to the accompanying drawings.

DETAILED DESCRIPTION OF THE PREFERRED EMBODIMENT

Figure 1:
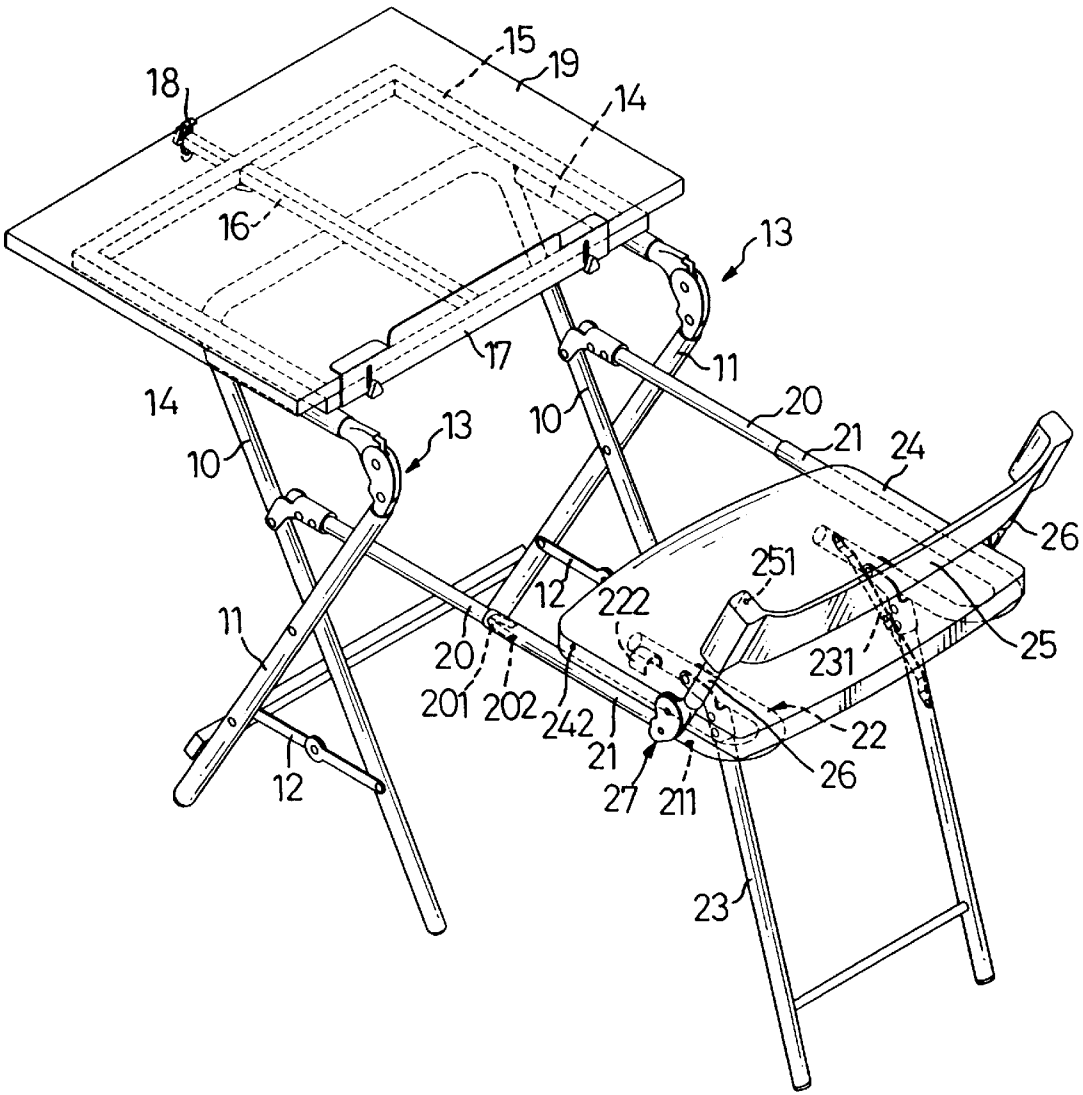
FIG. 1 is a perspective view of the combination desk and chair in accordance with the present invention.
Figure 2:
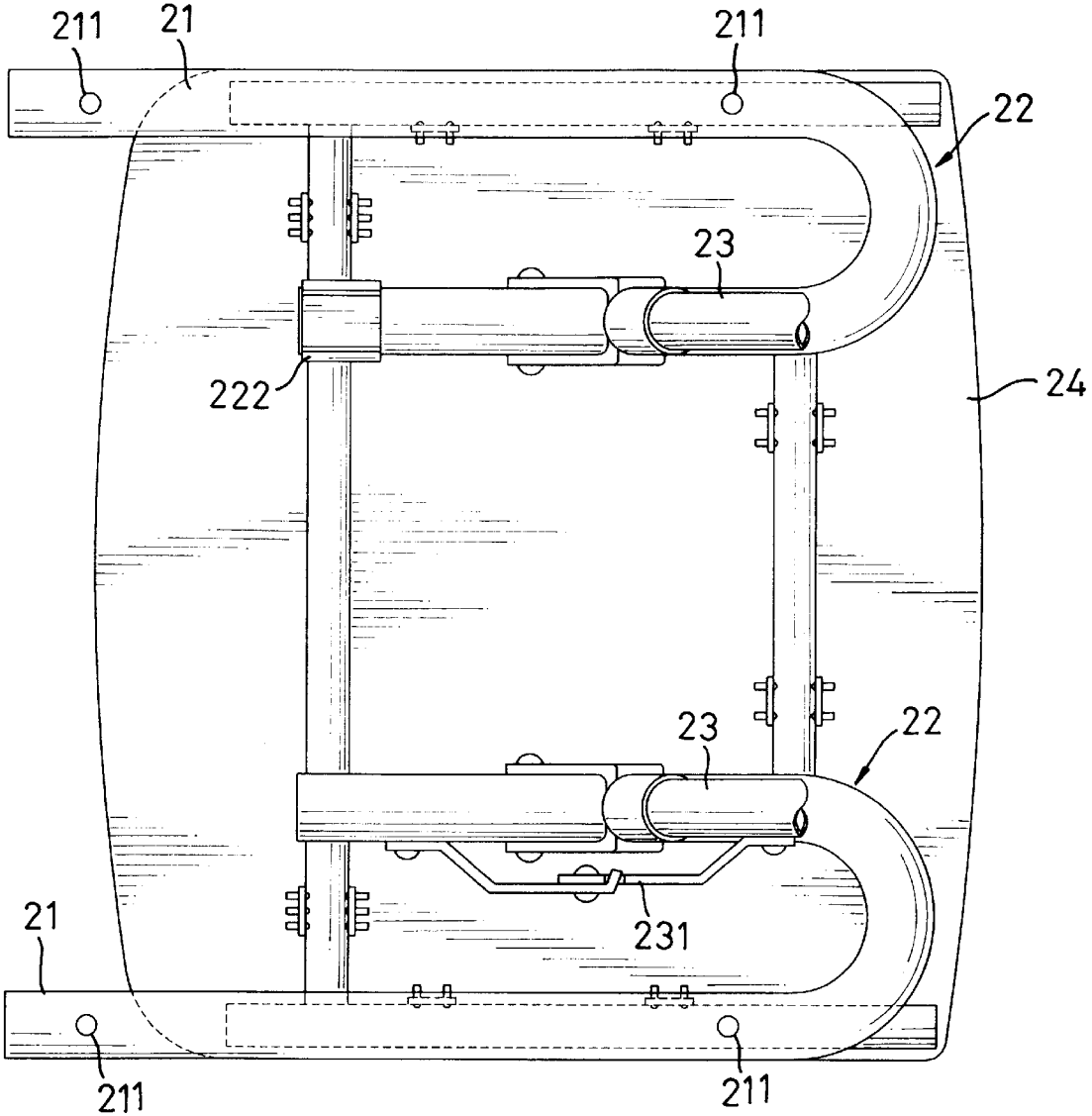
FIG. 2 is a bottom view to show the two U-shaped ends of the connecting means and the seat of the chair of the combination desk and chair in FIG. 1.
Figure 3:
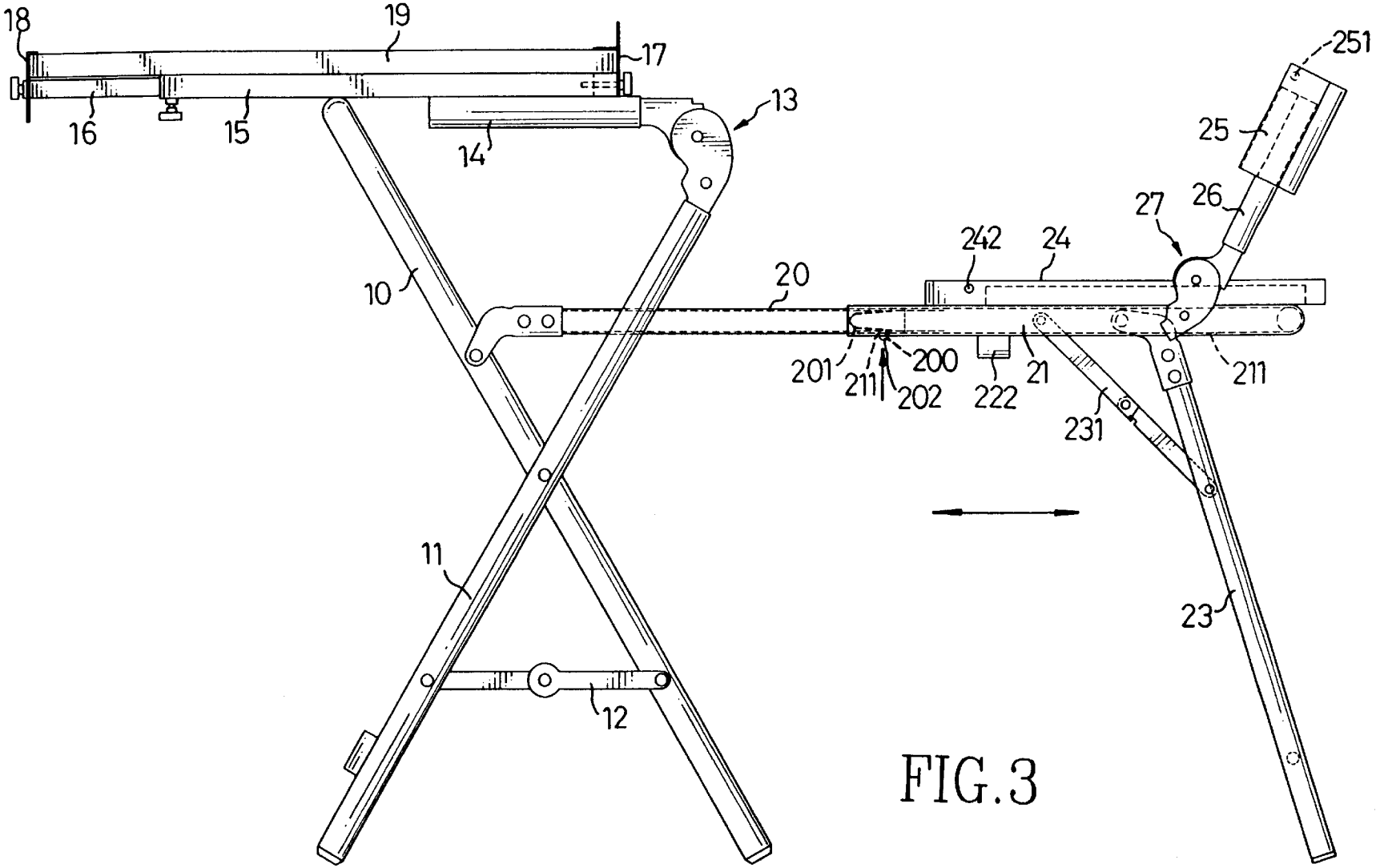
FIG. 3 is a side elevational view to show the structure of the retractable connecting means of the combination desk and chair in accordance with the present invention.

Referring to FIGS. 1 to 3, the combination desk and chair in accordance with the present invention comprises an inverted U-shaped member having two first legs (10) connected by a transverse bar (100). Two foldable members each have a horizontal section (14) and a supporting section (11) which is pivotably connected to the horizontal section (14) by pivoting members (13), the two supporting sections (11) respectively and pivotally intersecting the two first legs (10). A frame (15) is attached to the top of the two horizontal sections (14), supported by the transverse bar (100) and connected to the underside of a desk surface (19) so that the frame (15) is connected between the desk surface (19) and the two horizontal sections (14). Two pivotable connecting members (12) are respectively connected between the two pairs of the first leg (10) and the supporting section (11). A central rod (16) extends through the frame (15) and has the first end thereof connected with a first clamp means (17) which clamps the first end of the desk surface (19) and the frame (15), the second end of the central rod (16) extends through the frame (15) and connects to a second clamp means (18) which connects the desk surface (19) and the second end of the second clamp means (18) together.

Two connecting means each have the first end thereof pivotally connected to the two first legs (10) and the second end thereof attached to the underside of a seat (24). Each of the connecting means has an inner tube (20) and an outer tube (21) in which the inner tube (20) is slidably received. The inner tube (20) is connected to the corresponding first leg (10) and each of the outer tubes (21) has a U-shaped end (22), the seat (24) supported by the two respective U-shaped ends (22) of the two outer tubes (21). Two second legs (23) are pivotally connected to the two U-shaped ends (22) of the two connecting means and two pivotable connecting members (231) are respectively connected between the two pairs of the second leg (23) and the U-shaped end (22). Each of the U-shaped ends (22) has a receiving member (222) connected thereto which is sized to receive the second leg (23) corresponding thereto. A backrest (25) is pivotally connected across the two sides of the seat (24), wherein two stiles (26) respective extend from the two sides of the backrest (25) and are pivotally connected to the two outer tubes (21) by two respective pivoting members (27). The backrest (25) has two dents (251) defined in two insides thereof and the seat (24) has two bosses (242) respectively extending from the two sides thereof so that the two bosses (242) are received in the two dents (251) when the backrest (25) is pivoted to lie on the seat (24) as shown in FIG. 6.

Each of the inner tubes (20) has a positioning member (201) received in the end thereof received in the corresponding outer tube (21), a ball (202) extending from the positioning member (201) and protruding from the end of the inner tube (20) via an aperture (200) defined through the wall of the inner tube (20). Each of the outer tubes (21) has a plurality of holes (211) defined through the wall thereof so that the ball (202) is received in one of the holes (211) to adjust the distance between the disk surface (19) and the seat (24).

Figure 4:
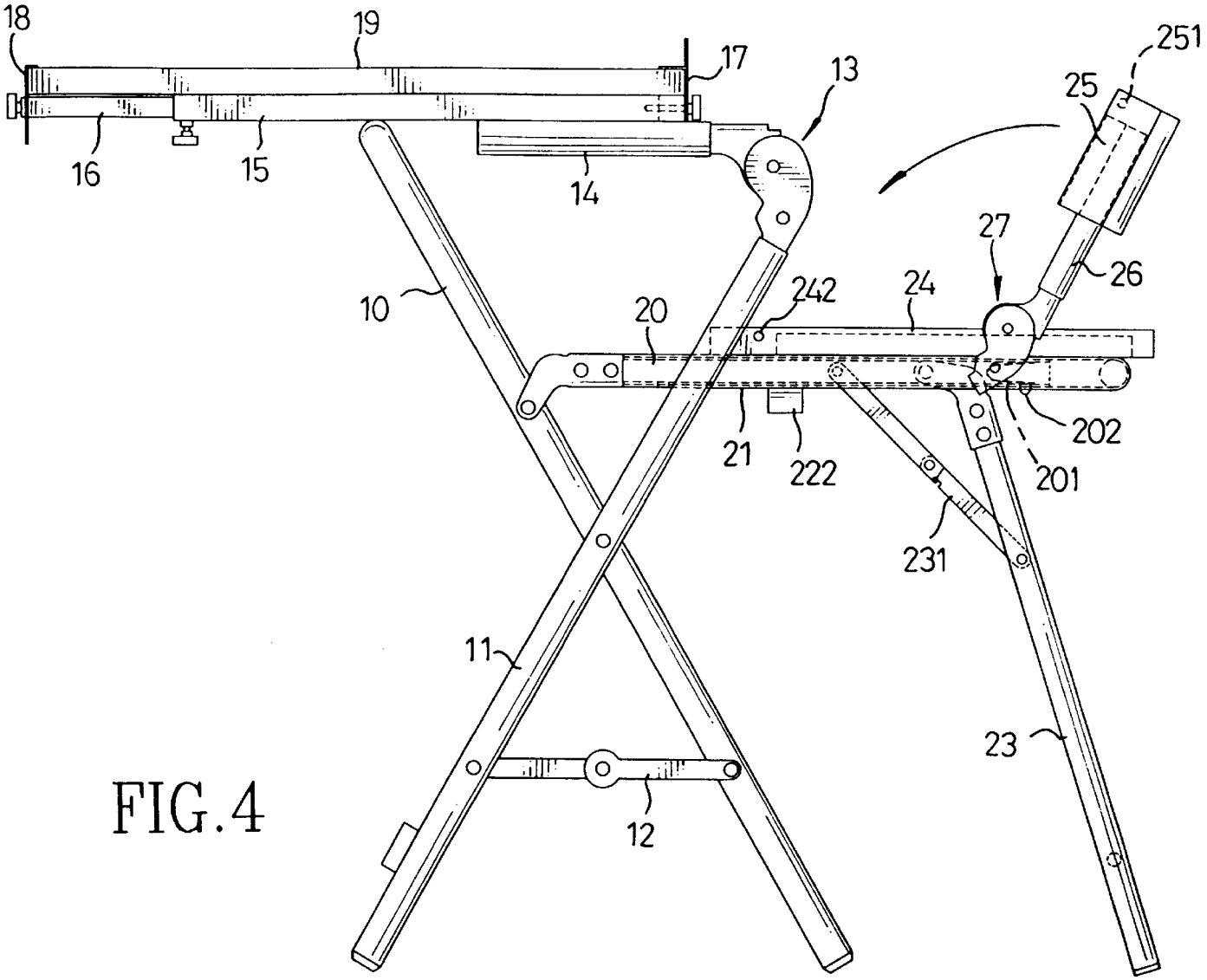
FIG. 4 is a side elevational view to show how the retractable connecting means are operated and the backrest of the chair is to be pivoted in accordance with the present invention.
Figure 5:
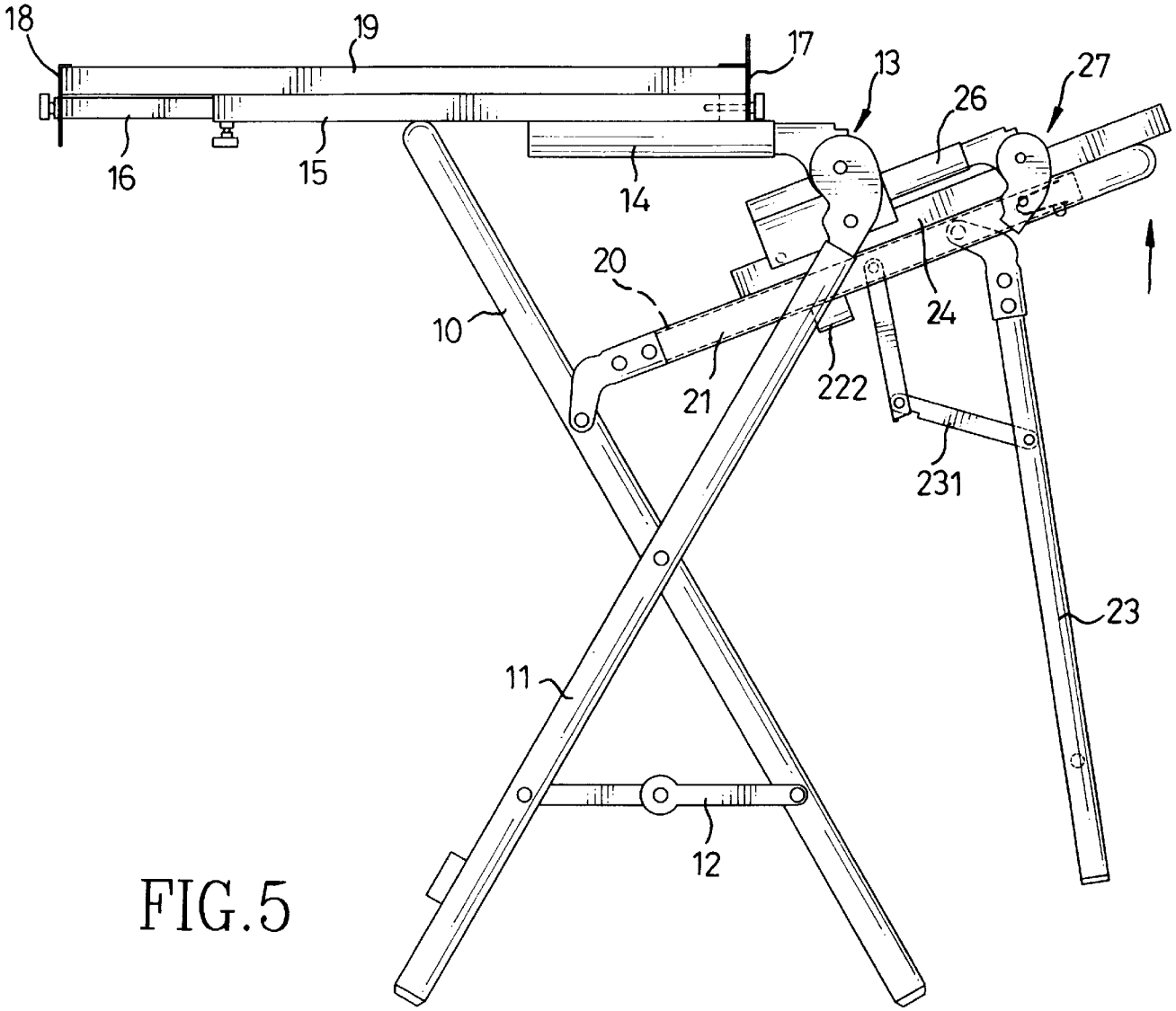
FIG. 5 is a side elevational view to show how the two legs of the chair are to be folded in accordance with the present invention.
Figure 6:
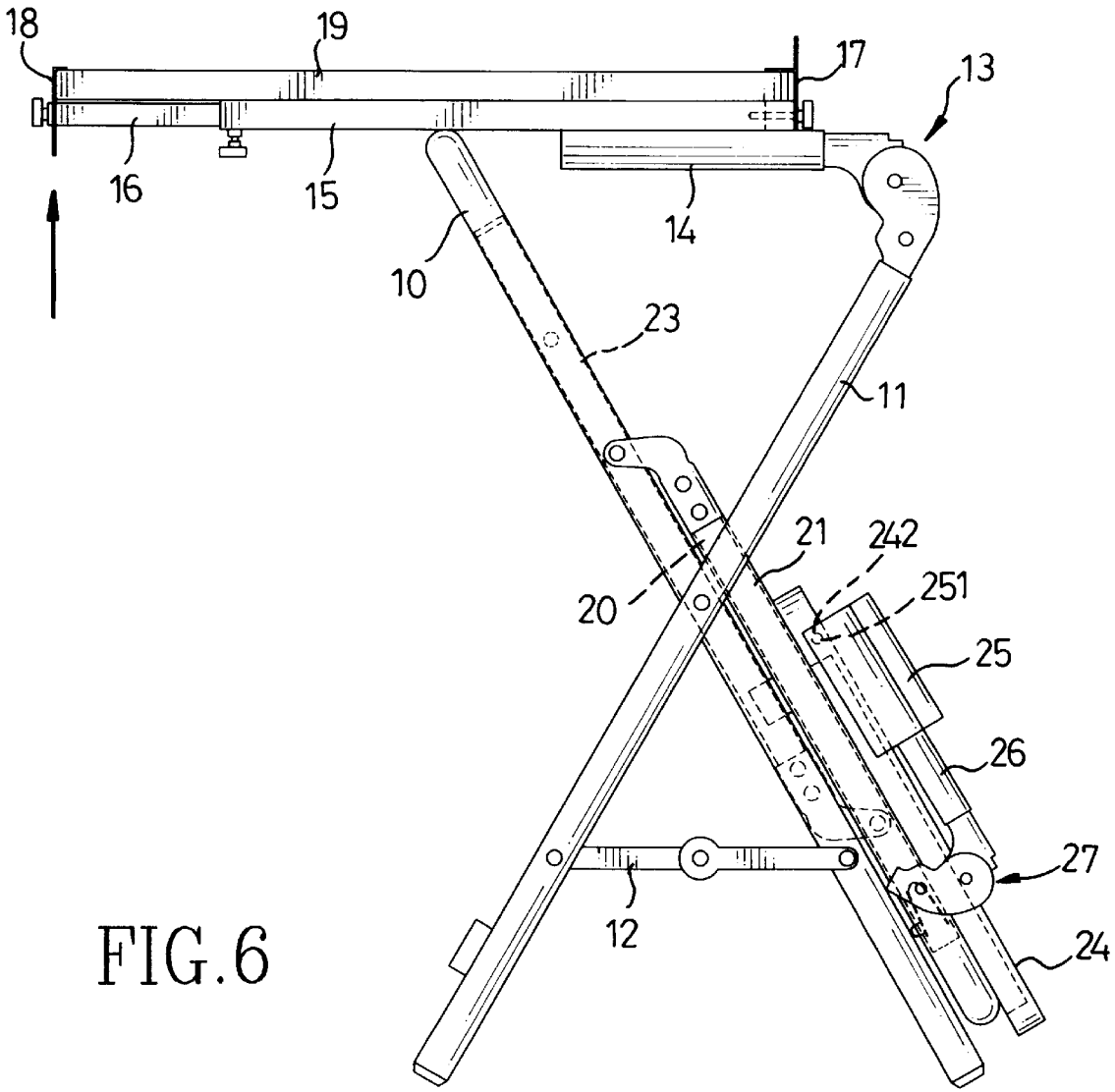
FIG. 6 is a side elevational view to show how the chair is folded to attach to the U-shaped supporting frame in accordance with the present invention.
Figure 7:
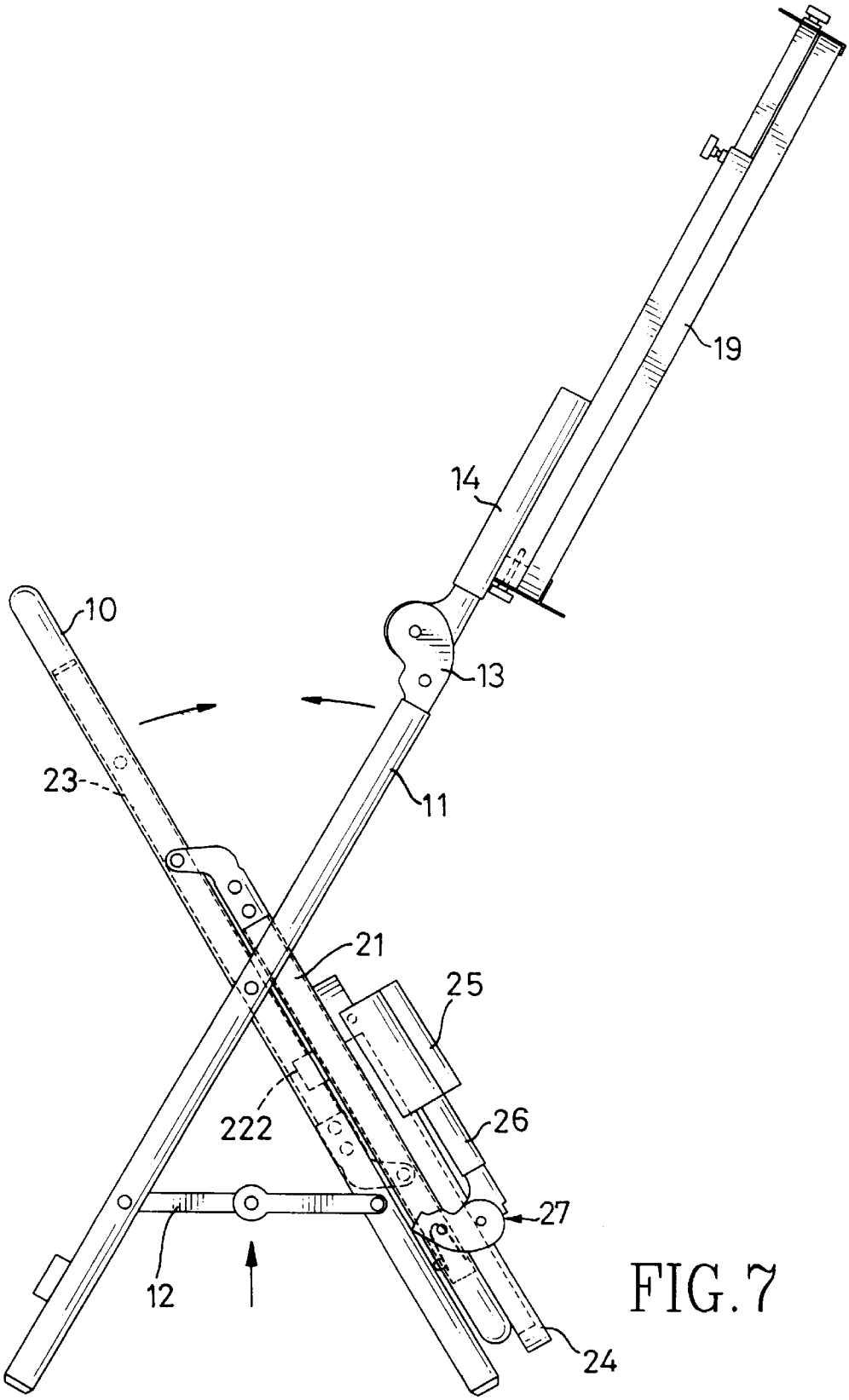
FIG. 7 is a side elevational view to show how the desk surface is pivoted and the supporting frame and the foldable members are to be pivoted toward with each other in accordance with the present invention.
Figure 8:
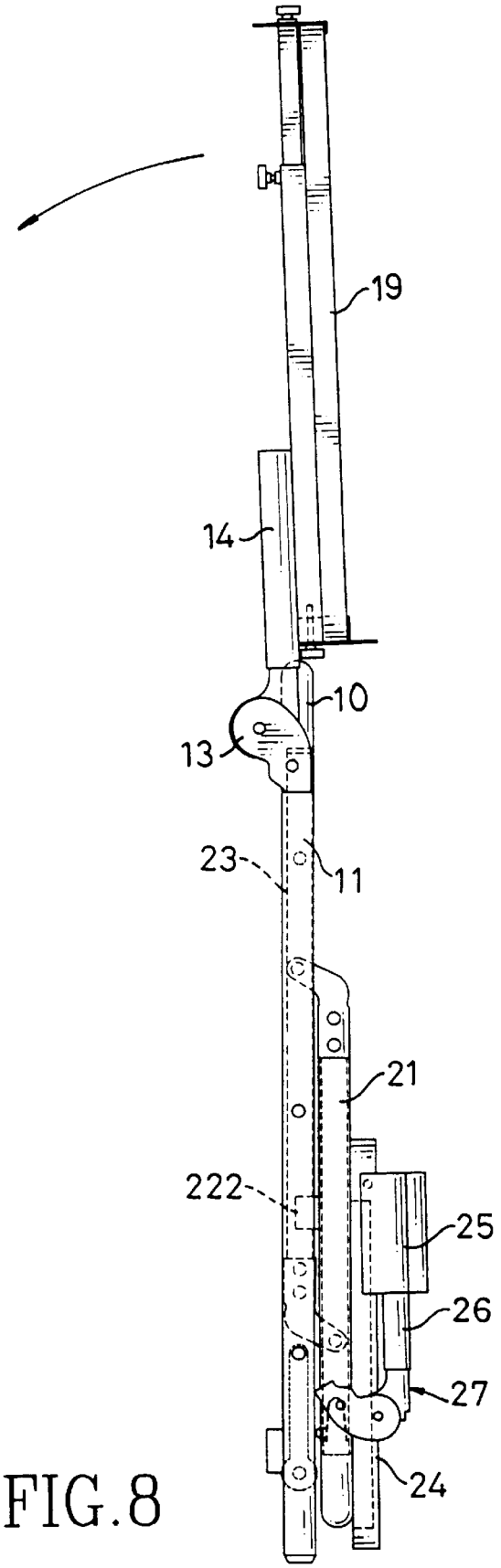
FIG. 8 is a side elevational view to show how the supporting frame and the foldable members are pivoted to contact side by side in accordance with the present invention.
Figure 9:
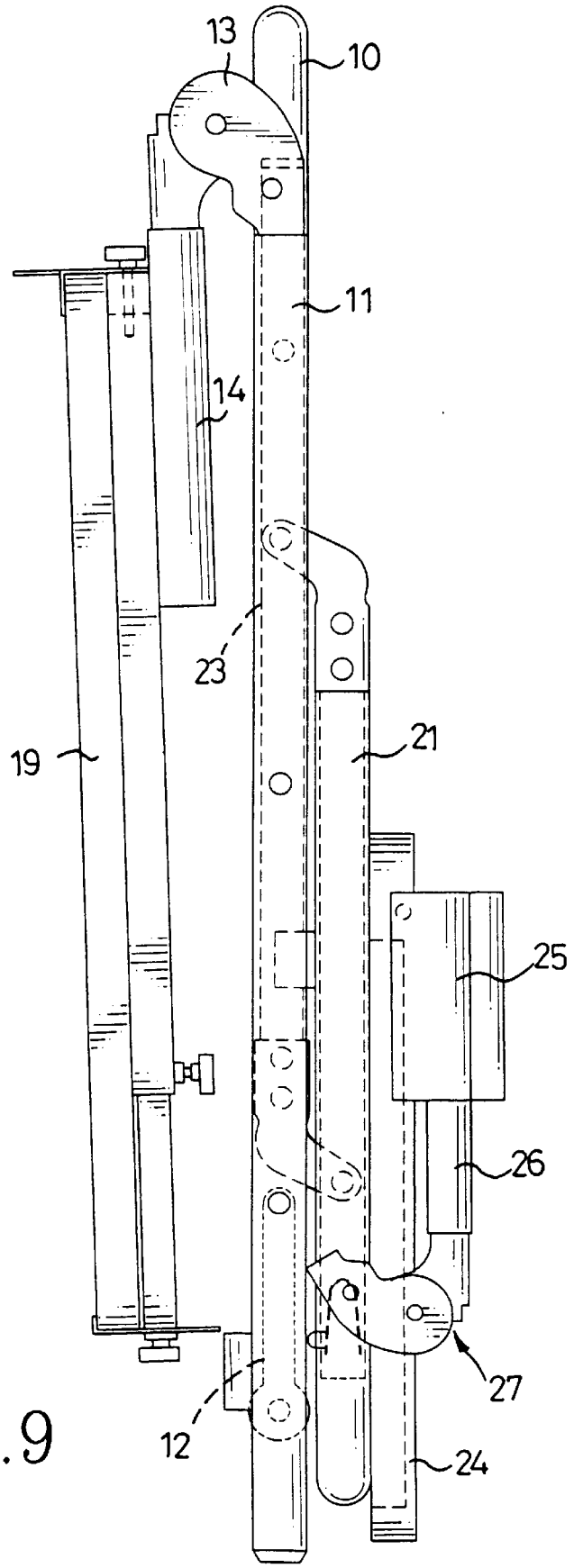
FIG. 9 is a side elevational view to show the final status of the combination desk and chair after being folded in accordance with the present invention.

FIGS. 4 to 6 show that when folding the combination desk and chair, the inner tubes (20) are received in the outer tubes (21) and the backrest (25) is pivoted to let the bosses (242) be received in the dents (251) in the backrest (25). The two pivotable connecting members (231) are folded to let the two second legs (23) be folded to be engaged with the two receiving members (222) on the outer tubes (21). Referring to FIGS. 7 to 9, the desk surface (19) together with the horizontal sections (14) are pivoted away from the inverted U-shaped frame and then pivoting the two pivotable connecting members (12) to make the two first legs (10) and the two supporting sections (11) to be in alignment with each other. Then the two horizontal sections (14) and the desk surface (19) are pivoted to be located beside the inverted U-shaped member as shown in FIG. 9.

Although the invention has been explained in relation to its preferred embodiment, it is to be understood that many other possible modifications and variations can be made without departing from the spirit and scope of the invention as hereinafter claimed.

What is claimed is:

1. A combination desk and chair, comprising:

an inverted U-shaped member having two first legs (10) connected by a transverse bar (100), two foldable members each having a horizontal section (14) and a supporting section (11) which is pivotably connected to said horizontal section (14) by a pivoting members (13), said two supporting sections (11) respectively and pivotally intersecting said two first legs (10), a desk surface (19) attached to said two horizontal sections (14), and two connecting means each having the first end thereof pivotally connected to said two first legs (10) and a seat (24) attached to two respective second ends of said two connecting means, two second legs (23) pivotally connected to said two second ends of said two connecting means.

2. The combination desk and chair as claimed in claim 1 further comprising a frame (15) attached to the underside of said desk surface (19) and connected between said desk surface (19) and said two horizontal sections (14).

3. The combination desk and chair as claimed in claim 1 further comprising a central rod (16) extending through said frame (15), said central rod (16) having the first end thereof connected with a first clamp means (17) which clamps the first end of said desk surface (19) and said frame (15), the second end of said central rod (16) extending through said frame (15) and connected to a second clamp means (18) which connects said desk surface (19) and said second end of said second clamp means (18) together.

4. The combination desk and chair as claimed in claim 1, wherein each of said connecting means includes an inner tube (20) and an outer tube (21) in which said inner tube (20) is slidably received.

5. The combination desk and chair as claimed in claim 4, wherein each of said outer tubes (21) has a U-shaped end (22) and said seat (24) is supported by said two respective U-shaped ends (22) of said two outer tubes (21).

6. The combination desk and chair as claimed in claim 5, wherein each of said U-shaped ends (22) has a receiving member (222) connected thereto which is sized to receive said second leg (23) corresponding thereto.

7. The combination desk and chair as claimed in claim 4, wherein each of said inner tubes (20) has a positioning member (201) received in an end thereof which is received in said corresponding outer tube (21), a ball (202) extending from said positioning member (201) and protruding from said end of said inner tube (20), each of said outer tubes (21) having a plurality of holes (211) defined through the wall thereof so that said ball (202) is received in one of said holes (211) to adjust the distance between said desk surface (19) and said seat (24).

8. The combination desk and chair as claimed in claim 1, wherein a backrest (25) is pivotally connected across the two sides of said seat (24).

9. The combination desk and chair as claimed in claim 8, wherein said backrest (25) has two dents (251) defined in two insides thereof and said seat (24) has two bosses (242) respectively extending from the two sides thereof so that said two bosses (242) are received in said two dents (251) when said backrest (25) is pivoted to lie on said seat (24).

* * * * *